United States Patent [19]

Dugge

[11] 4,036,408

[45] July 19, 1977

[54] HOPPER HAVING MEANS FOR DIRECTING BLASTS OF GAS TO A DISCHARGE OUTLET OR THE HOPPER

[75] Inventor: Richard H. Dugge, St. Louis, Mo.

[73] Assignee: ACF Industries, Incorporated, New York, N.Y.

[21] Appl. No.: 644,363

[22] Filed: Dec. 24, 1975

[51] Int. Cl.[2] ..... B65G 3/12

[52] U.S. Cl. ..... 222/193; 222/195; 301/53

[58] Field of Search ..... 222/195, 193; 302/53

[56] References Cited

U.S. PATENT DOCUMENTS

| | | | |
|---|---|---|---|
| 2,187,376 | 1/1940 | Guibert | 222/193 |
| 3,147,892 | 9/1964 | McCullough | 222/195 |
| 3,166,222 | 1/1965 | Schrader | 222/105 |
| 3,218,175 | 11/1965 | Siegel | 222/195 X |
| 3,716,082 | 2/1973 | Green | 222/193 X |
| 3,733,012 | 5/1973 | Grin | 222/193 |
| 3,942,689 | 3/1976 | Dakin et al. | 222/195 |

FOREIGN PATENT DOCUMENTS

| | | | |
|---|---|---|---|
| 797,659 | 10/1968 | Canada | 222/195 |

*Primary Examiner*—Robert B. Reeves
*Assistant Examiner*—Frederick R. Handren
*Attorney, Agent, or Firm*—Henry W. Cummings

[57] ABSTRACT

A hopper for lading having a lower discharge outlet and a gas discharge nozzle extending into the hopper above the discharge outlet through which blasts of gas may be directed into the hopper to break up the lading and facilitate discharge of the lading through the discharge outlet. A conduit is mounted within the hopper extending between the end of the gas discharge nozzle and the discharge outlet to direct blasts of gas from the gas discharge nozzle to the discharge opening of the outlet to break up lading bridged across the outlet opening. The gas discharge nozzle is of elbow shape and rotatably mounted whereby it may be rotated to either direct blasts of gas through the conduit to the opening of the outlet or to direct blasts of gas to other areas of the hopper.

5 Claims, 12 Drawing Figures

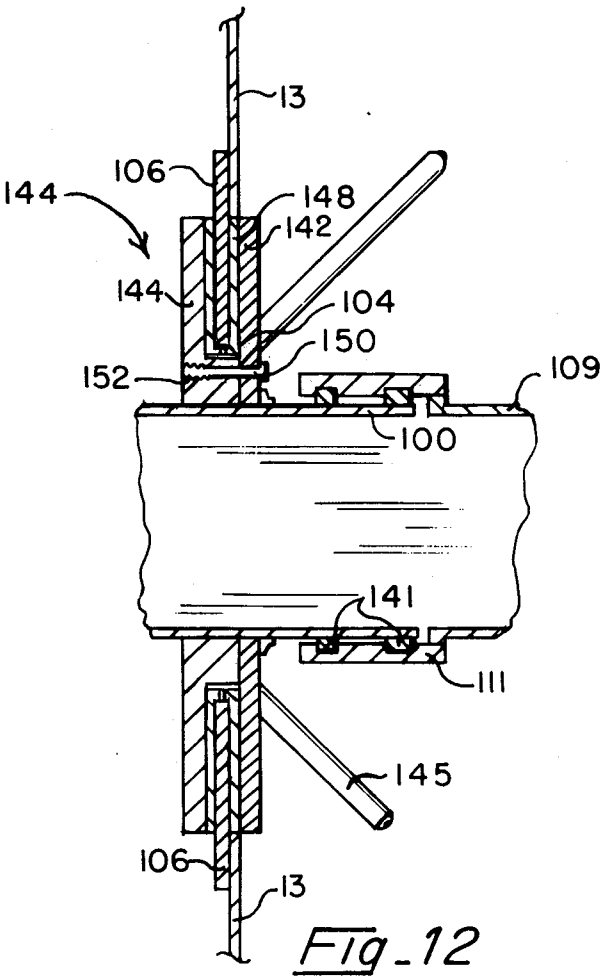
Fig. 12
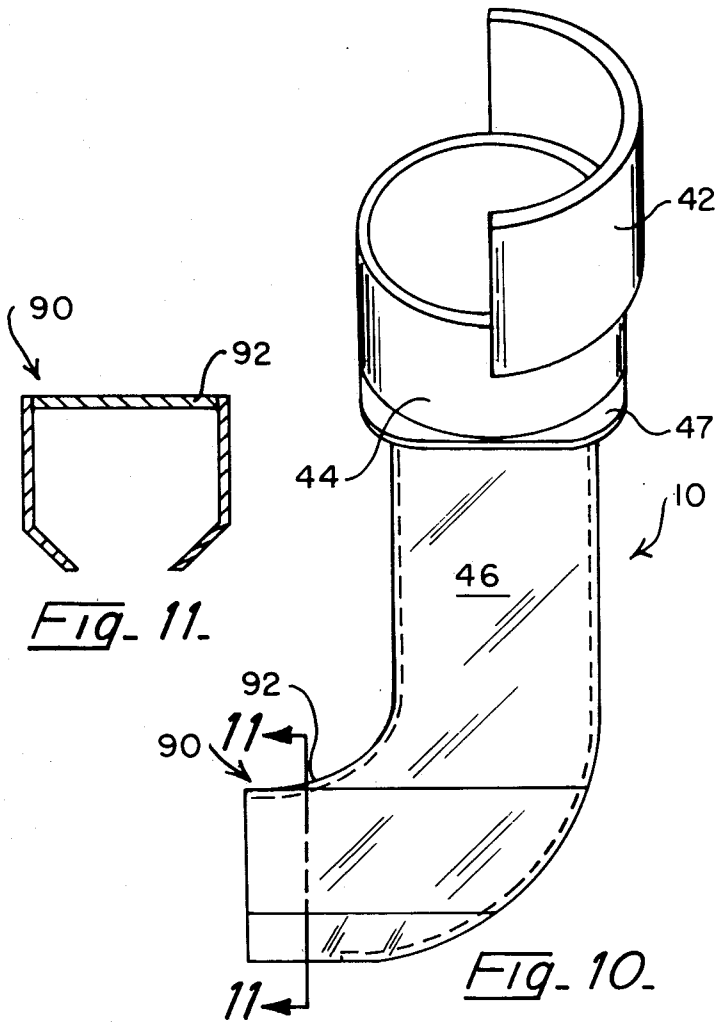
Fig. 10.
Fig. 11.

HOPPER HAVING MEANS FOR DIRECTING BLASTS OF GAS TO A DISCHARGE OUTLET OR THE HOPPER

BACKGROUND OF THE INVENTION

This invention relates to an apparatus to facilitate unloading of a difficult to unload lading from a hopper. The hopper may be stationary such as an industrial bin, or movable such as an intermodal transit hopper container, or a railway hopper car.

DESCRIPTION OF THE PRIOR ART

It has previously been proposed to mount one or more gas discharge devices on the slope sheets of a hopper containing a difficult to unload lading. Such discharge devices have a nozzle extending into the hopper for directing a blast of gas into the hopper to reduce clogging and bridging of the lading so that the lading can be unloaded by conventional gravity or pneumatic unloading equipment. A gas discharge device of this type is shown and described in U. S. Pat. No. 3,788,527.

It has also previously been proposed to form the nozzle of an elbow shape and rotatably mount the elbow shaped nozzle whereby the nozzle may be rotated manually or by recoil to direct blasts of gas to different areas of the hopper. A rotatable, elbow shaped nozzle adapted to be rotated by recoil is shown and described in application Ser. No. 525,492 filed Nov. 20, 1974, now U. S. Pat. No. 3,758,722, assigned to the same assignee as this application.

Because of clearance requirements it has been found necessary in many applications, and in particular railway hopper cars, to locate the gas discharge devices on the hopper slope sheets some distance above the outlet and for this reason these devices have not been fully effective in breaking up lading that may bridge over the outlet opening, particularly difficult to unload ladings such as film scrap and crumb rubber. However, after the lading directly over the outlet has been broken loose and has begun to flow, the gas discharge devices are effective to remove the remaining material.

The Drawings

FIG. 10 is a view of another embodiment of the present invention illustrating another gas directing contour which may be utilized in the conduit;

FIG. 11 is a sectional view looking in the direction of the arrows along the line 11—11 in FIG. 10; and FIG. 12 is a sectional view of a bearing assembly which may be utilized in the present invention looking in the direction of the arrows along the line 12—12 in FIG. 1.

SUMMARY OF THE INVENTION

It is an object of the present invention to provide apparatus for breaking up bridged or clogged lading located directly over the outlet opening in a hopper containing a difficult to unload lading.

It is another object of the invention to locate portions of such apparatus inside the hopper to comply with external outlet clearance restrictions, such as Association of American Railroads hopper car clearance requirements.

In accordance with the present invention a conduit is mounted within the hopper and extends between the nozzle of a gas discharge device extending into the hopper above the hopper outlet, and the vicinity of a transversely extending hopper outlet opening. A blast of gas which discharges from the discharge device is directed downwardly by the conduit into the area immediately above the outlet to break-up bridged or clogged lading directly above and adjacent the hopper outlet. The lower end of the conduit is provided with a contour to direct the blast of gas in both directions along the transversely extending outlet, or in a selected direction, only. As a feature of the invention, the nozzle is of elbow shape and is rotatably mounted within the hopper whereby the nozzle may be rotated to either direct a blast of gas through the conduit to the outlet opening, or to other areas of the hopper.

DESCRIPTION OF PREFERRED EMBODIMEMTS

Figures 1, 2, 3, 4:
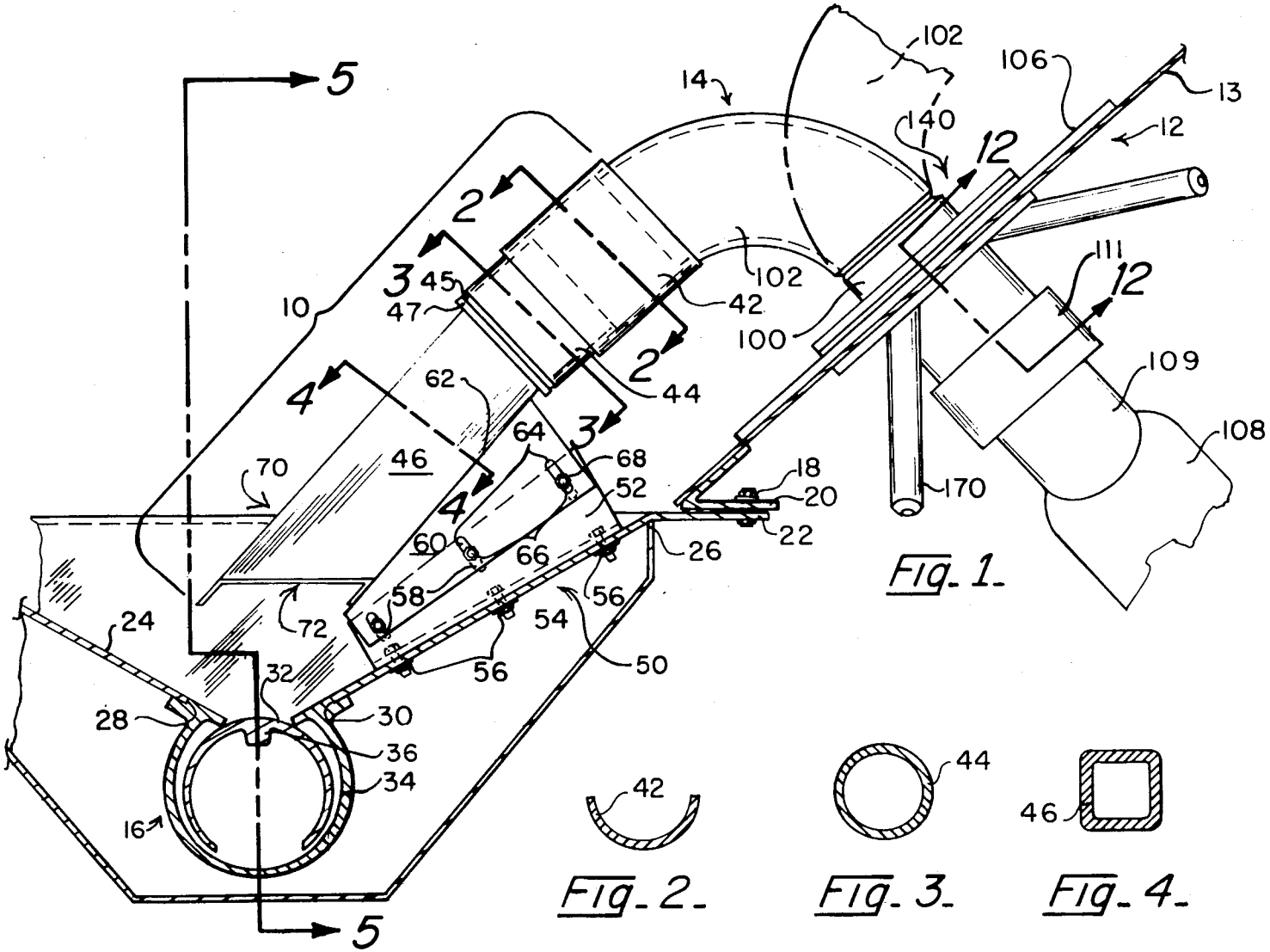
FIG. 1 is a sectional view of a hopper adapted to contain a difficult to unload lading and illustrating the conduit of the present invention mounted between a nozzle for directing blasts of gas into the hopper and a hopper outlet.
FIG. 2 is a sectional view of the conduit elbow engagement portion looking in the direction of the arrows along the line 2—2 in FIG. 1.
FIG. 3 is a sectional view of the upper conduit portion looking in the direction of the arrows along the line 3—3 in FIG. 1.
FIG. 4 is a sectional view of the main conduit portion looking in the direction of the arrows along the line 4—4 in FIG. 1.

As is illustrated in FIG. 1 of the drawings a conduit 10 is mounted in a hopper 12 between a nozzle 14 for directing blasts of gas into the hopper, and a hopper discharge outlet 16. The outlet construction is not critical and a wide variety of pneumatic or gravity outlets may be used. The particular outlet 16 disclosed in the drawings is of the type described in U.S. Pat. No. 3,778,114. The outlet 16 is mounted on the lower end of the hopper 12 by means of suitable fasteners 18 passing through a flange 20 on the hopper and a mounting flange 22 on the outlet. The outlet includes inclined slope sheets 24 and 26 having spaced lower inner edges 28 and 30. The outlet includes a lower housing 34 affixed to lower inner edges 28 and 30 of the slope sheets 24 and 26. Housing 34 is provided with an outlet opening 32. A lading discharge control tube 36 is provided within housing 34. The discharge control tube may be provided with longitudinally spaced openings 38 and 40 (FIG. 5) for unloading the respective sides of the outlet. Sleeves 39 at each end of the tube may be rotated with handles 41 integral therewith for rotating the control tube 36 to align the openings 38 and 40 with the opening 32 to allow lading to pass from the hopper 12 into the housing 34. The lading is then unloaded pneumatically by removing suitable caps 239*a* (FIG. 5) from the ends of the sleeves 39 and applying a suction hose to one of the sleeves 39. Additional construction details of the outlet 16 and the operation thereof may be found in U.S. Pat. No. 3,778,114 which is hereby incorporated into the present application by this reference.

Nozzle 14 extends through the hopper slope sheet 13 and is provided with an elbow shaped discharge end 102 for directing blasts of gas into the upper end of conduit 10. As will be described in detail hereafter in connection with FIG. 12, nozzle 14 is preferably rotatably mounted in hopper slope sheet 13 so that elbow shaped end 102 may be rotated out of communication with the upper end of conduit 10 as shown dotted in FIG. 1 so as to direct blasts of gas to other portions of the hopper to facilitate unloading.

The nozzle 14 includes a conduit portion 100 which extends through an opening 104 (FIG. 12) provided in a mounting plate 106 which is integrally affixed to the surface of the slope sheet 13 above the discharge outlet 16. A gas discharge device 108 (FIG. 1) having a discharge conduit 109 is connected to the outer end of the conduit portion 100 of the nozzle 14 on the exterior of the hopper. The discharge device 108 may be of the type described in U.S. Pat. No. 3,788,527 and reference is made thereto for a detailed description of the structure and operation thereof. It is sufficient for an understanding of the present invention to note that the discharge device 108 is capable of providing periodic discharges of a blast of gas of sufficient force to dislodge bridged lading in hopper 12. Suitable supports (not shown) are provided to support the discharge device 108 on the outside of the hopper slope sheet 13. When the discharge device 108 is discharged, a blast of gas is directed through conduit 109, through conduit portion 100 of nozzle 14, through elbow portion 102 to the upper end of conduit 10, and through conduit 10 to the vicinity of the outlet 16.

Figure 5:
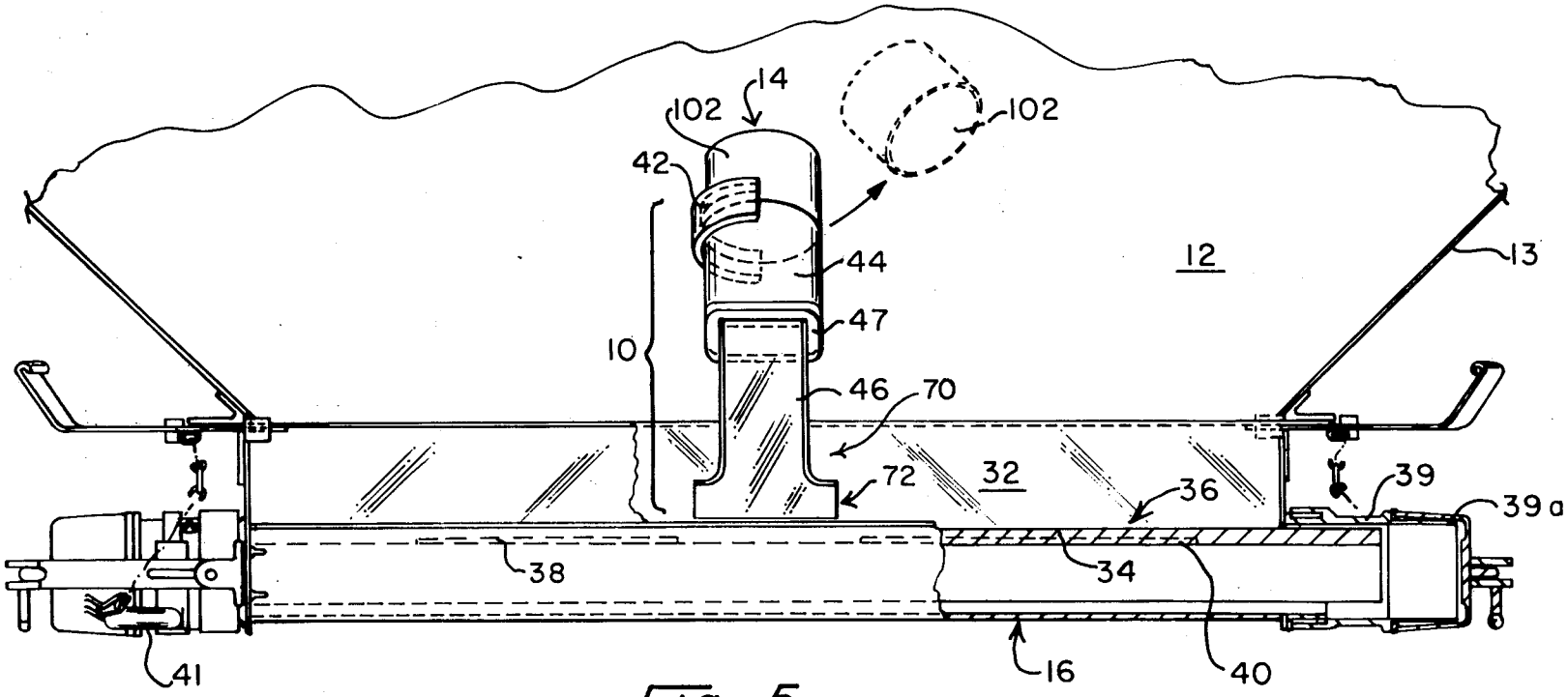
FIG. 5 is a partial sectional view looking in the direction of the arrows along the line 5—5 in FIG. 1.

Conduit 10 includes an upper generally semicircular elbow engagement portion 42 (FIG. 2) which is adapted to engage the end of the elbow portion 102 when it is rotated into the position shown in solid lines in FIG. 1 and FIG. 5. Elbow engagement portion 42 is welded to the upper end of an upper conduit portion 44 which, as illustrated in FIG. 3, has a circular cross section. Upper conduit portion 44 has a lower flange 45 which is welded to an upper flange 47 of main conduit portion 46 which as shown in FIG. 4 has a rectangular cross section.

Adjustable conduit support means, indicated at 50, are provided for supporting the conduit 10 within the hopper 12. The support means 50 includes a plate 52 having a mounting flange 54 through which fasteners 56 pass to mount the support plate on one of the outlet slope sheets 26. Plate 52 is provided with a plurality of fastening slots 58. A cooperating support plate 60 is integrally affixed to main conduit portion 46 by welding or with fasteners. Plate 60 is preferably cut on an incline as indicated at 62 to generally follow conduit portion 46 and the usual inclination of the outlet slope sheets 26. Fastening slots 64 are provided in plate 60 to align with slots 58 in plate 52 for proper placement and adjustment of conduit 10 in the hopper 12. After proper alignment and adjustment of conduit 10, fasteners 66 are inserted through the slots 58 and 64 and nuts 68 applied thereto and tightened to support the conduit 10 on slope sheet 26 in the proper position.

The lower end of the portion 46 of conduit 10 is provided with a blast directing discharge portion 70 including a contour 72 adapted to direct a blast of gas passing through the conduit into and/or around outlet opening 32 and housing 34.

Figure 7:
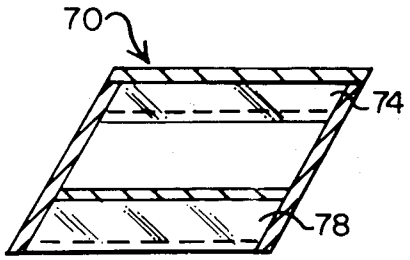
FIG. 7 is a sectional view looking in the direction of the arrows along the line 7—7 in FIG. 6.
Figure 6:
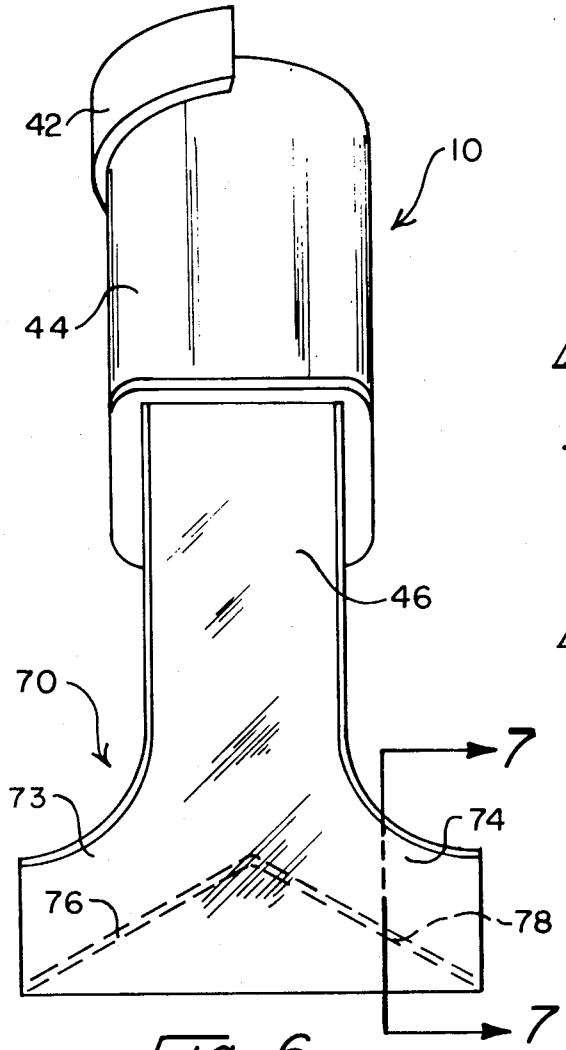
FIG. 6 is a view of an embodiment of the present invention illustrating one contour which may be utilized for the gas directing portion of the conduit.

A variety of gas directing contours may be utilized. For example, as illustrated in FIGS. 5–7, contour 72 may comprise oppositely directed conduit portions 73 and 74 which will direct a blast of gas in both directions along opening 32 and/or discharge housing 34. As shown in FIG. 7 the cross-section of discharge portions 73 and 74 is generally rectangular. For more precise direction of the gas, lower discharge plates 76 and 78 may be provided in portions 73 and 74 which tend to direct the gas downwardly and into the discharge housing 34.

As is illustrated in FIG. 5 of the drawings for some applications it is preferred to mount conduit 10 so that the gas directing portion 70 of the conduit is positioned just above the outlet opening 32 at about the midpoint of the outlet. This is conveniently done by mounting the conduit 10 at about the transverse center line of the outlet.

Figure 8:
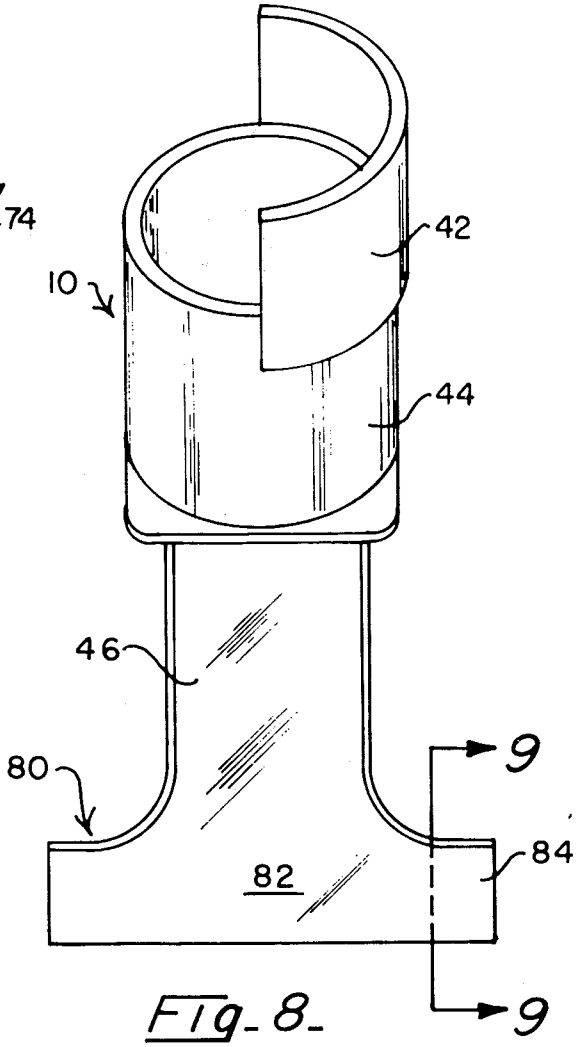
FIG. 8 is a view of another embodiment of the present invention illustrating another contour for the gas directing portion of the conduit.
Figure 9:
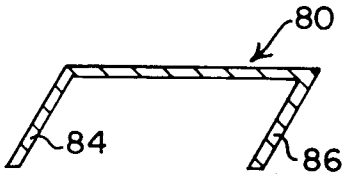
FIG. 9 is a sectional view looking in the direction of the arrows along the line 9—9 in FIG. 8.

Another embodiment of the lower gas directing portion of the conduit 10 is illustrated in FIGS. 8 and 9. In this embodiment, the gas directing portion 80 is simply flared outwardly in both directions along discharge housing 34 as indicated at 82, and plate portions 84 and 86 extend downwardly in the direction of the outlet as best shown in FIG. 9. In this embodiment the gas tends to be directed more longitudinally along the openings 32 rather than downwardly into the discharge conduit as is the case with the embodiment shown in FIGS. 5 – 7.

In still another embodiment illustrated in FIGS. 10 and 11 the gas directing portion 90 comprises an approximately right angle bend indicated at 92. The conduit portion may be rectangular as illustrated in FIG. 11. This embodiment is useful when it is desired to direct the entire blast of gas into the first side of the outlet to be unloaded. For some ladings it has been found that if the bridge can be broken above the outlet opening on the first side of the outlet to be unloaded, the unloading then proceeds without additional blasting to the second side of the outlet to be unloaded. The embodiment shown in FIGS. 10 and 11 may be mounted in any desired transverse position in the hoppers.

As previously noted, the nozzle 14 is preferably rotatably mounted in the slope sheet 13 of the hopper 12 so that the elbow shaped end 102 may be rotated out of communication with the upper end of conduit 10 whereby blasts of gas may be directed to other areas of the hopper 12. An arrangement for mounting the nozzle 14 for such rotation is shown in FIG. 12.

Referring to FIG. 12, a discharge conduit portion 109 of the discharge device 108 has a sleeve 111 of increased diameter attached thereto and the end of conduit portion 100 of nozzle 14 extends within sleeve 11. A bearing assembly 141 is provided between conduit portion 100 of nozzle 14 and the sleeve 11 of discharge outlet portion 109 whereby the nozzle 14 may rotate relatively to portion 109 and the discharge device 108. The portion 100 of the nozzle is in turn mounted for rotation in the opening 104 of the plate 106 of hopper side sheet 13 by means of an annular plate 142 which is secured to portion 100 on exterior side of the plate 106, and an annular plate 144 loosely surrounding portion 100 on the opposite side of plate 106. Bearing material 148 is interposed between plates 142 and plate 106 and plate 144 and plate 106. A plurality of fasteners 150 are provided which pass through plate 144 and threaded into threads 152 in plate 142 whereby the nozzle 14 is clamped to the plate 106 and supported in the opening 104 of plate 106 for rotation relatively to the plate 106 and the gas discharge device 108. The friction between plates 142 and 144 against plate 106 can be varied by the extent to which fasteners 150 are tightened into threads 152. Handles 145 secured to and extending from plate 142 may be used to rotate the nozzle 14 from the exterior of the hopper.

In operation handles 145 are used to rotate the elbow 102 of nozzle 14 into alignment with the upper end of conduit 10 or in other directions to direct a blast of gas into other areas of hopper 12, such as the position shown in broken lines in FIG. 1. Fasteners 150 may be tightened to maintain the nozzle in a particular position. As shown in FIG. 5, when the nozzle 14 is rotated to bring the end of elbow shaped portion 102 into alignment with the upper end of conduit 10, the end of elbow shaped portion 102 engages the semicircular upper portion 42 of the conduit 10 thereby insuring that the portion 102 of the nozzle is properly aligned with upper end of the conduit 10.

To unload the lading in the hopper, the elbow 14 is first rotated to the position shown in solid lines in FIGS. 1 and 5 and one or more blasts of gas discharged from discharge device 108 will pass through conduit portion 109, nozzle 14 and downwardly through conduit 10 into gas directing portion 70. Gas directing contour 72 will direct the blast of gas into opening 33 and/or around housing 34 to dislodge lading bridged or clogged around the outlet. The lading may then be unloaded through outlet 16. During unloading through outlet 16, nozzle 14 may be rotated out of communication with conduit 10 to direct blasts of gas from discharge device 108 into other areas of hopper 12 to break up bridged or clogged lading, and thus assist in unloading the lading from the hopper.

It will be apparent to those skilled in the art that modifications of the present invention are possible. For example, while upper conduit portion has been illustrated as circular, other cross sections such as rectangular may be used. Similarly, main conduit portion while illustrated as rectangular may have any desired cross section.

Furthermore, the particular gas directing contours 72 illustrated are intended as examples only. The present invention is not to be considered as limited to the specific contours illustrated.

What is claimed is:

1. A hopper having a plurality of inclined sides; a bottom discharge outlet attached to the lower ends of the inclined sides;

a nozzle for directing blasts of gas into said hopper extending through one of said sides and into the interior of said hopper at a position spaced above said discharge outlet;

the portion of said nozzle extending within said hopper being of elbow shape;

a conduit fixedly mounted within said hopper, said conduit communicating at one end with said nozzle and extending downwardly to said discharge outlet to direct blasts of gas from said nozzle toward said discharge outlet;

means mounting said nozzle for rotation within said hopper between a first position aligned wth and communicating with said one end of said conduit to direct blasts of gas toward said discharge outlet to dislodge bridged or clogged lading adjacent said outlet, and a plurality of other positions directing said elbow shaped portion to other areas of the hopper between a first position aligned with and dislodge bridged or clogged lading at said other areas.

2. A hopper according to claim 1 wherein said conduit includes a gas directing contour at the lower portion thereof.

3. A hopper according to claim 2 wherein said gas directing contour comprises a contour which directs said blast of gas in opposite directions along said outlet.

4. A hopper according to claim 2 wherein said gas directing contour comprises a contour which directs a blast of gas generally in only one direction along said outlet.

5. A hopper according to claim 3 wherein a pair of inclined plates are provided in said contour to direct said gas downwardly and outwardly from said conduit into and around said outlet.

* * * * *

UNITED STATES PATENT AND TRADEMARK OFFICE

CERTIFICATE OF CORRECTION

PATENT NO. : 4,036,408

DATED : July 19, 1977

INVENTOR(S) : R. H. Dugge

It is certified that error appears in the above-identified patent and that said Letters Patent are hereby corrected as shown below:

Column 1, line 32, "3,758,722" should read -- 3,958,722 --.

Column 4, lines 58 and 60, "sleeve 11" should read -- sleeve 111 --.

Claim 1, line 23, "wth" should read -- with --.

Claim 1, lines 29 - 31 should read -- hopper to direct blasts of gas to said other areas to dislodge bridged or clogged lading at said other areas. --.

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*